US008783815B2

(12) United States Patent
Hara et al.

(10) Patent No.: US 8,783,815 B2
(45) Date of Patent: Jul. 22, 2014

(54) PRINTER

(71) Applicant: Riso Kagaku Corporation, Tokyo (JP)

(72) Inventors: Masashi Hara, Ibaraki-ken (JP); Hitoshi Arai, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/865,461

(22) Filed: Apr. 18, 2013

(65) Prior Publication Data

US 2013/0278667 A1 Oct. 24, 2013

(30) Foreign Application Priority Data

Apr. 24, 2012 (JP) ..... 2012-098796

(51) Int. Cl.

| | |
|---|---|
| ***B41J 29/38*** | (2006.01) |
| ***B41J 2/01*** | (2006.01) |
| ***B41J 13/32*** | (2006.01) |
| ***B41J 13/08*** | (2006.01) |
| ***B41J 11/48*** | (2006.01) |

(52) U.S. Cl.

CPC *B41J 13/32* (2013.01); *B41J 13/08* (2013.01); *B41J 11/485* (2013.01)

USPC ..... 347/16; 347/101; 347/104; 347/105

(58) Field of Classification Search

CPC ..... B41J 13/32; B41J 13/08; B41J 13/02; B41J 13/103

USPC ..... 347/16, 101, 104–105

See application file for complete search history.

(56) References Cited

U.S. PATENT DOCUMENTS

| | | | | |
|---|---|---|---|---|
| 8,305,416 | B2 * | 11/2012 | Maeda | 347/237 |
| 2003/0090563 | A1 * | 5/2003 | Tomita et al. | 347/245 |

FOREIGN PATENT DOCUMENTS

| | | | |
|---|---|---|---|
| JP | 2010-215389 | A | 9/2010 |

* cited by examiner

*Primary Examiner* — Jason Uhlenhake

(74) *Attorney, Agent, or Firm* — Nath Goldberg & Meyer; Jerald L. Meyer; Stanley N. Protigal

(57) ABSTRACT

A printer includes a pair of registration rollers for feeding a print sheet to a print unit, a first sheet supply unit including a first feed roller that operates, by rotating in synchronization with the pair of registration rollers, an assistant operation to assist sheet-feeding by the pair of registration rollers, a second sheet supply unit including a second feed roller, a drive unit that selectively drives the first and second feed rollers, and a controller that controls the drive unit. When changing over a sheet supply source from the first sheet supply unit to the second sheet supply unit in the assistant operation, the controller finishes the assistant operation before a trailing edge of a print sheet currently fed has passed through the first feed roller by stopping the drive unit. According to the printer, reduction of print productivity can be restricted while reducing noises and feed failures.

4 Claims, 7 Drawing Sheets

PRINTER

BACKGROUND OF THE INVENTION

1. Technical Field

The present invention relates to a printer for printing on a print medium.

2. Background Arts

Generally, known is a printer with a mechanism in which a print sheet picked-up from a sheet supply tray is fed to a print unit having inkjet heads and so on by a pair of registration rollers. In such a mechanism, a pint sheet is stalled in a state where its leading edge is contacted to a registration nip between the registration rollers to slack the print sheet, so that an oblique feed of the print sheet can be compensated. Then, the registration rollers are driven to feed the print sheet to the print unit.

When the print sheet is fed forward by the registration rollers, the slack of the print sheet is expanded (i.e. back tension is applied to the print sheet) between the registration nip of the registration rollers and their upstream rollers. As a result, a noise (sheet expansion noise) may be generated due to the expansion of the slack.

A Japanese Patent Application Laid-Open No. 2010-215389 (Patent Document 1) discloses a printer in which an assistant operation is carried out. In the assistant operation, upstream rollers located upstream from the registration rollers are driven while registration rollers are being driven in order to reduce the above-explained sheet expansion noise, so that noise suppression is improved. In addition, feeding failures can be also reduced according to the assistant operation, so that feed performance is improved.

The printer disclosed in the Patent Document 1 includes sheet supply trays disposed at a lower portion of the printer, and a sheet supply side-tray that is partially exposed to the outside of the printer. When supplying a print sheet from one of the sheet supply trays, a print sheet fed out from the sheet supply tray by rollers is received by intermediate feed rollers (corresponding to the above-explained upstream rollers), and the intermediate feed rollers feed it to registration rollers. The print sheet fed from the intermediate feed rollers is stalled in a state where its leading edge is contacted to a registration nip between the registration rollers, so that a slack of the print sheet is formed. Then, the intermediate feed rollers start the assistant operation at the same time when the registration rollers start to be driven. In the assistant operation, the intermediate feed rollers are driven in synchronization with the registration rollers. According to the assistant operation, the intermediate feed rollers and the registration rollers feed the print sheet while they maintain the slack of the print sheet. At a time when a trailing edge of the print sheet has passed through the intermediate feed rollers, the intermediate feed rollers finish the assistant operation.

On the other hand, when supplying a print sheet from the sheet supply side-tray, a print sheet fed out from the sheet supply side-tray by primary supply rollers (corresponding to the above-explained upstream rollers) is received by the registration rollers. The primary supply rollers start an assistant operation at the same time when the registration rollers start to be driven, and then finish the assistant operation at a specific timing. As explained above, the primary supply rollers feed a print sheet out from the sheet supply side-tray, and then feed it to the registration rollers. In order not to feed a next print sheet out from the sheet supply side-tray erroneously by the primary supply rollers, the primary supply rollers are not are driven in synchronization with the registration rollers during the assistant operation. The assistant operation is finished before a trailing edge of the print sheet being fed out from the sheet supply side-tray has passed through the primary supply rollers.

SUMMARY OF THE INVENTION

There is a printer provided with such a mechanism disclosed in the Patent Document 1, and its intermediate feed rollers and its primary supply rollers are driven by a single motor in order to downsize the printer. The intermediate feed rollers and the primary supply rollers have to be driven alternately in the downsized printer, so that the intermediate feed rollers and the primary supply rollers cannot be driven concurrently.

As explained above, the assistant operation by the intermediate feed rollers is continued until the trailing edge of the print sheet has passed through the intermediate feed rollers. Therefore, according to a configuration for driving the intermediate feed rollers and the primary supply rollers alternately by a single motor, picking-up and feed-start of a next print sheet is subject to be delayed when a supply source of a print sheet is changed from the sheet supply tray(s) to the sheet supply side-tray. As a result, print productivity is subject to be reduced. Especially, when a print mode accompanied by frequent changes of a supply source is carried out, reduction of print productivity becomes conspicuous.

An object of the present invention is to provide a printer that can restrict reduction of print productivity while reducing noises and feed failures.

An aspect of the present invention provides a printer that includes a print unit including at least one print head; a pair of registration rollers for feeding a print sheet to the print unit; a first sheet supply unit including a first feed roller that feeds a print sheet to the pair of registration rollers, and operates, by rotating in synchronization with the pair of registration rollers, an assistant operation to assist feeding of the print sheet by the pair of registration rollers; a second sheet supply unit including a second feed roller that feeds a print sheet to the pair of registration rollers; a drive unit that selectively drives the first feed roller and the second feed roller; and a controller that controls the drive unit, wherein the controller, when changing over a sheet supply source of print sheets from the first sheet supply unit to the second sheet supply unit in the assistant operation by the first feed roller, finishes the assistant operation before a trailing edge of a print sheet currently fed has passed through the first feed roller by stopping the drive unit.

According to the aspect, when a sheet supply source is changed over from the first sheet supply unit to the second sheet supply unit, the controller finishes the assistant operation by the first feed roller before a trailing edge of a print sheet has passed through the first feed roller by stopping the drive unit. Therefore, the printer can reduce a delay in starting to feed the next print sheet from the second sheet supply unit, and thereby a time loss caused by changing over the sheet supply source. As a result, the printer can restrict reduction of print productivity while reducing sheet expansion noises due to a back tension applied to a print sheet caused by the assistant operation and reducing feed failures.

It is preferable that, when changing over the sheet supply source from the first sheet supply unit to the second sheet supply unit in the assistant operation by the first feed roller, the controller finishes the assistant operation according to a drive schedule of the pair of registration rollers for setting sheet distances between sequentially-fed print sheets to a predetermined distance.

According to this configuration, in the print productivity priority mode, the printer can feed print sheets sequentially with constant sheet distances even when a sheet supply source is changed over from the first sheet supply unit to the second sheet supply unit. As a result, the printer can maintain print productivity while reducing sheet expansion noises due to a back tension applied to a print sheet caused by the assistant operation and reducing feed failures.

It is preferable that the printer is provided with a print productivity priority mode in which the assistant operation by the first feed roller is finished before a trailing edge of a print sheet currently fed has passed through the first feed roller, and a noise suppression priority mode in which the assistant operation by the first feed roller is finished when or after a trailing edge of a print sheet currently fed has passed through the first feed roller, and that, when changing over the sheet supply source from the first sheet supply unit to the second sheet supply unit in the assistant operation by the first feed roller, the controller is capable of selecting the print productivity priority mode or the noise suppression priority mode according to a print job.

According to this configuration, the controller selects the print productivity priority mode or the noise suppression priority mode according to the print job, so that the printer can execute sheet-supplying/feeding appropriate for the print job.

DESCRIPTION OF THE EMBODIMENTS

Figure 1:
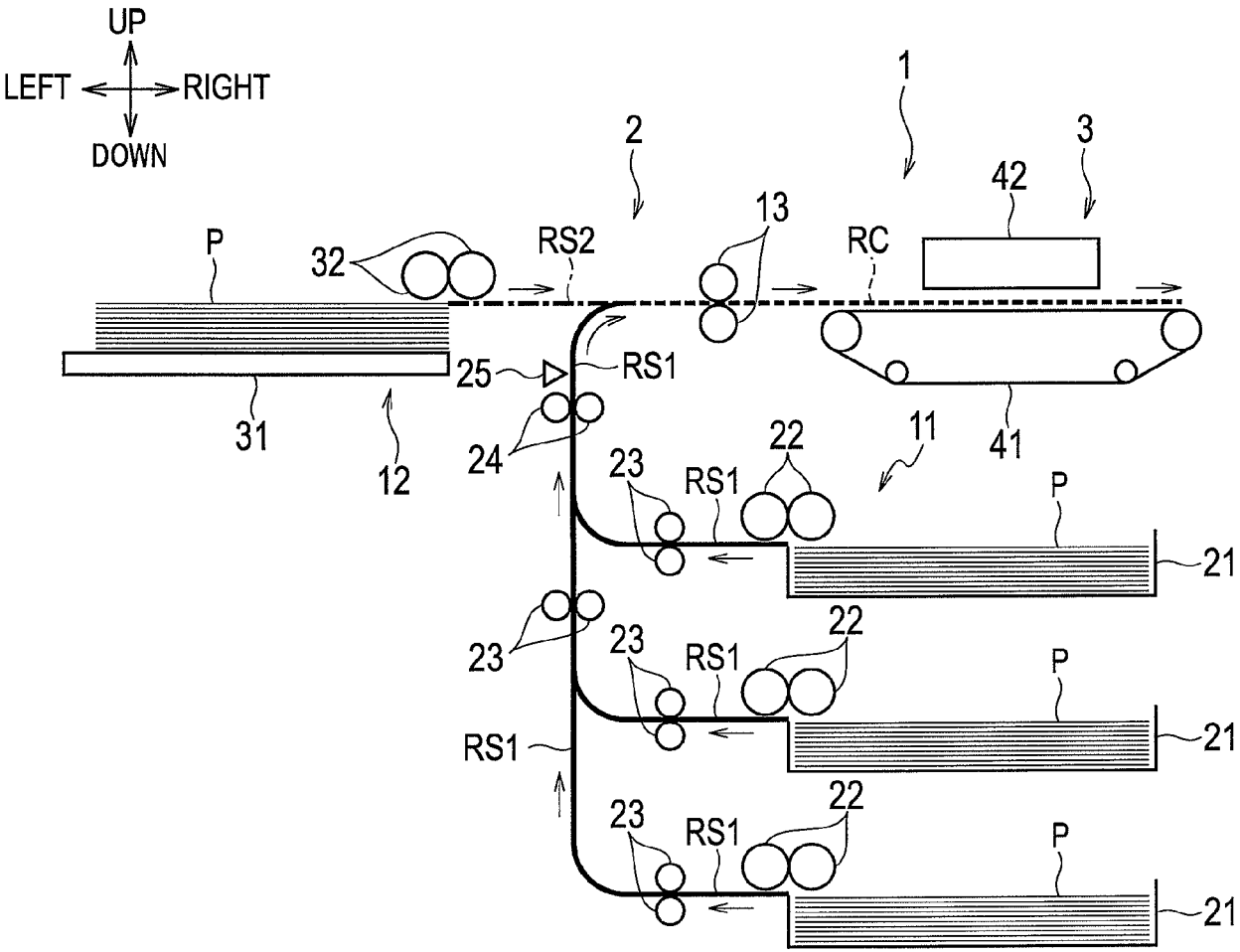
FIG. 1 is a schematic configurational diagram of a printer according to an embodiment.

Embodiments will be explained with reference to the drawings hereinafter. In the drawings, an identical component or a similar component is indicated by an identical reference number. But, the drawings show components schematically, and it should be considered they are not shown in the drawings precisely as they are. In addition, dimensions of the components and dimensional proportions between the components may change in the drawings.

Further, the embodiments described below are explained as examples that specifically carry out the subject matter of the present invention, and the subject matter of the present invention is not limited to the embodiments. The embodiments may be modified within the scope of the claims (e.g. arrangement of components may be changed from the embodiment). FIG. 1 shows a printer 1 according to an embodiment.

In FIG. 1, paths indicated by bold lines are feed paths along which a print sheet(s) P as a print medium (media) are fed. Among the feed path, solid bold lines indicate internal sheet supply paths RS1, a dashed-dotted bold line indicates an external sheet supply path RS2, and a dotted bold line indicates a print path RC. Arrows besides the paths indicate feed directions of a print sheet P. In following descriptions, terms "upstream" and "downstream" mean upstream and downstream along the paths, respectively. A direction perpendicular to a plane of FIG. 1 is defined as a front-back direction. A direction from the plane of FIG. 1 to a near (front) side is defined as a front direction, and another direction from the plane of FIG. 1 to a far (back) side is defined as a back direction. In addition, "upward", "downward", "leftward" and "rightward" when viewed from the near side are defined as up, down, left and right directions, respectively.

Figure 2:
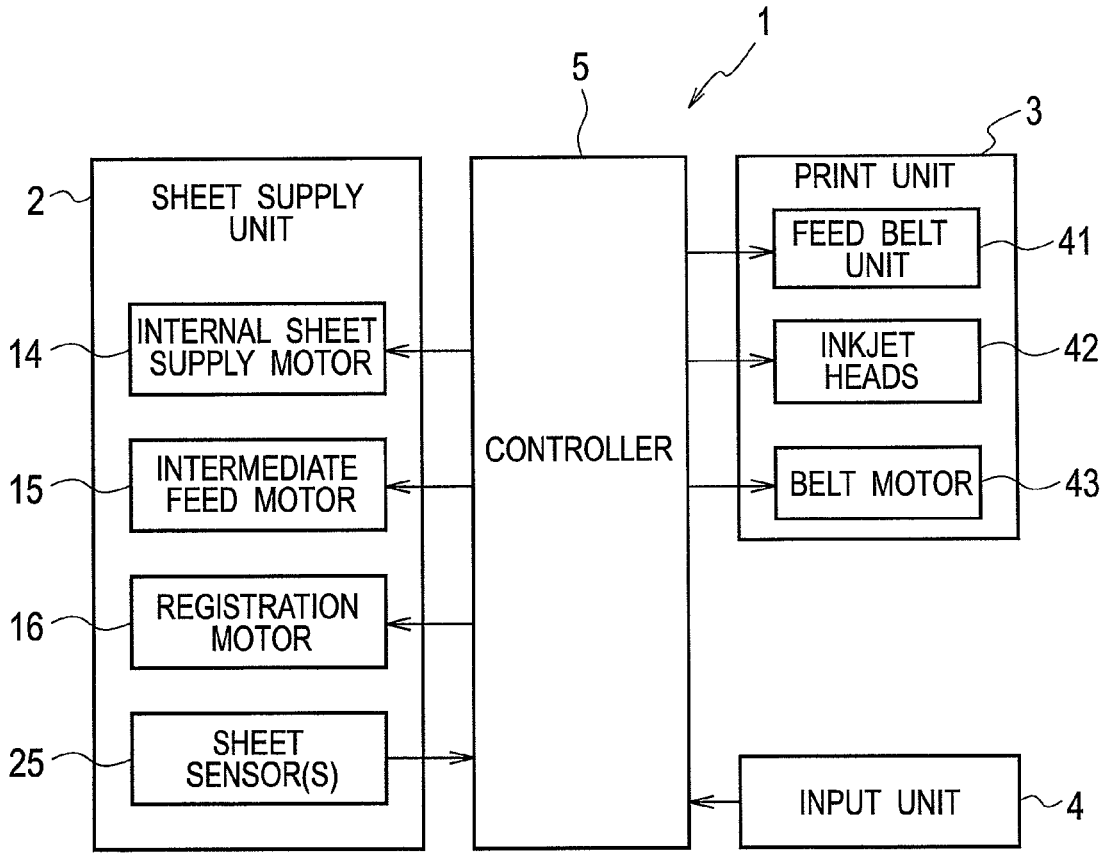
FIG. 2 is a block diagram showing a control system of the printer.

As shown in FIG. 1 and FIG. 2, the printer 1 according to the present embodiment includes a sheet supply unit 2, a print unit 3, an input unit 4, and a controller 5.

The sheet supply unit 2 supplies a print sheet(s) P. The sheet supply unit 2 includes an internal sheet supply unit 11, an external sheet supply unit 12, registration rollers 13, an internal sheet supply motor 14, an intermediate feed motor 15, and a registration motor 16.

The internal sheet supply unit 11 feeds a print sheet P to the registration rollers 13. The internal sheet supply unit 11 is disposed in the inside of the printer 1. The internal sheet supply unit 11 includes plural internal sheet supply trays 21, plural pairs of internal sheet supply rollers 22, plural pairs of feed rollers 23, intermediate feed rollers 24, and a sheet sensor 25. The internal sheet supply unit 11 is served as a first sheet supply unit defined in claims.

On each of the internal sheet supply trays 21, print sheets P to be used for printing are stacked. The internal sheet supply trays 21 are disposed below the print unit 3 in a multi-drawer manner.

Each pair of the internal sheet supply rollers 22 picks up print sheets P from the internal sheet supply tray 21 sheet by sheet, and feeds them out to the internal sheet supply path RS1. The pairs of the internal sheet supply rollers 22 are disposed above the internal sheet supply trays 21, respectively.

Each pair of the feed rollers 23 feed the print sheet P that has fed out from the internal sheet supply tray 21 to the intermediate feed rollers 24. The pairs of the feed rollers 23 are disposed along the internal sheet supply paths RS1.

The intermediate feed rollers 24 receive the print sheet P that has been fed out from any one of the sheet supply trays 21 and are fed along the internal sheet supply path RS1 by the feed rollers 23, and feed it to the registration rollers 13. The intermediate feed rollers 24 assist the registration rollers 13 by its operations synchronized with the registration rollers 13. The intermediate feed rollers 24 are disposed at a downstream section of the internal sheet supply path(s) RS1. The intermediate feed rollers 24 are served as a first feed roller defined in claims.

The sheet sensor 25 detects a print sheet P at a position just downstream from the intermediate feed rollers 24, and then outputs the detection signal to the controller 5. The sheet sensor 25 is composed of an optical sensor including a light emitting element and a light receiving element.

The external sheet supply unit 12 feeds a print sheet P to the registration rollers 13. The external sheet supply unit 12 includes an external sheet supply tray 31 and a pair of external sheet supply rollers 32. The external sheet supply unit 12 is served as a second sheet supply unit defined in claims.

On the external sheet supply tray 31, print sheets P to be used for printing are stacked. The external sheet supply tray 31 is disposed in a manner where it is partially exposed to the outside of the printer 1.

The pair of the external sheet supply rollers 32 picks up print sheets P from the external sheet supply tray 31 sheet by sheet, and feeds them out to the external sheet supply path RS2. The pair of the external sheet supply rollers 32 is disposed above the external sheet supply tray 31. The external sheet supply rollers 32 are served as are served as a second feed roller defined in claims.

The registration rollers 13 stall a print sheet P that has been fed out from the internal sheet supply unit 11 or the external sheet supply unit 12, and then feed it to the print unit 3 after forming a slack of the print sheet P. The registration rollers 13 operate intermittently in synchronization with each of print sheet P. The registration rollers 13 are disposed, on the print path RC, at a position near a confluent point of the internal sheet supply path RS1 and the external sheet supply path RS2.

The internal sheet supply motor 14 drives the internal sheet supply rollers 22 and the feed rollers 23. The internal sheet supply motor 14 can be connected and disconnected with the internal sheet supply rollers 22 and the feed rollers 23 by clutches (not shown). The internal sheet supply rollers 22 and the feed rollers 23 to be connected with the internal sheet supply motor 14 are changed over by the clutches.

The intermediate feed motor 15 selectively drives the intermediate feed rollers 24 or the external sheet supply rollers 32. Specifically, the intermediate feed motor 15 drives the external sheet supply rollers 32 by its normal rotational drive, and drives the intermediate feed rollers 24 by its reverse rotational drive. A one-way clutch is disposed between the intermediate feed motor 15 and the intermediate feed rollers 24, and another one-way clutch is disposed between the intermediate feed motor 15 and external sheet supply rollers 32. According to these one-way clutches, the intermediate feed rollers 24 are not made driven, while the external sheet supply rollers 32 are being driven by the normal rotational drive of the intermediate feed motor 15. On the other hand, the external sheet supply rollers 32 are not made driven, while the intermediate feed rollers 24 are being driven by the reverse rotational drive of the intermediate feed motor 15. The intermediate feed motor 15 is served as a drive unit defined in the claims.

The registration motor 16 drives the registration rollers 13.

The print unit 3 prints on a print sheet P while feeding the print sheet P that has been supplied. The print unit 3 disposed downstream from the registration rollers 13. The print unit 3 includes a feed belt unit 41, inkjet heads 42, and a belt motor 43.

The feed belt unit 41 feeds a print sheet P that has been fed from the registration rollers 13 while holding it thereon by suctioning. Therefore, the feed belt unit 41 also includes a suction unit for suctioning a print sheet P onto its continuous loop belt (feed belt) wound around rollers.

The inkjet heads 42 are line-type inkjet heads that includes nozzles aligned along a direction (front-back direction) almost perpendicular to a feed direction of a print sheet P. The inkjet heads 42 are disposed above the feed belt unit 41. The inkjet heads 42 print images on a print sheet P fed by the feed belt unit 41 by injecting ink droplets onto the print sheet P.

The belt motor 43 rotates drive rollers around which the feed belt of the feed belt unit 41 is wound. The feed belt is moved to feed a print sheet P when the drive rollers are rotated by the belt motor 43.

The input unit 4 is a unit for receiving a user's input operation(s). The input unit 4 includes operational buttons, a touchscreen and so on in order to receive various operational commands and settings input by a user.

The controller 5 generally controls operations of the printer 1. The controller 5 is configured to include a CPU, a RAM, a ROM, a hard disk drive and so on. In the present embodiment, the controller 5 can select a print productivity priority mode and a silent (noise suppression) mode. The modes can be selected by a user's operation input to the input unit 4, for example.

The print productivity priority mode is a mode for restricting reduction of print productivity by reducing time loss due to an assistant operation of the intermediate feed rollers 24 when changing over a supply source of print sheets P to be fed to the registration rollers 13 from the internal sheet supply unit 11 to the external sheet supply unit 12. Specifically, in the print productivity priority mode, the controller 5 finishes the assistant operation by the intermediate feed rollers 24 before a trailing edge of a print sheet has passed through the intermediate feed rollers 24 when changing over a supply source of print sheets P from the internal sheet supply unit 11 to the external sheet supply unit 12.

The silent (noise suppression priority) mode is a mode for restricting the above-explained sheet expansion noise due to a back tension applied to a print sheet P. In the silent mode, the controller 5 finishes the assistant operation by the intermediate feed rollers 24 after a trailing edge of a print sheet has passed through the intermediate feed rollers 24 when changing over a supply source of print sheets P from the internal sheet supply unit 11 to the external sheet supply unit 12.

Next, operations of the printer 1 will be explained.

When receiving a print job, the controller 5 starts sheet supply from the internal sheet supply unit 11 or the external sheet supply unit 12. When a print sheet P fed out from the internal sheet supply unit 11 or the external sheet supply unit 12 is stalled by the registration rollers 13 and a preferred slack is formed on the print sheet P, the controller 5 drives the registration rollers 13 to feed the print sheet P to the print unit 3. In the print unit 3, the print sheet P is fed by the feed belt unit 41 and, concurrently, ink droplets are ejected from the inkjet heads 42 to print images on the print sheet P.

In the printer 1, an assistant operation in which the intermediate feed rollers 24 or the external sheet supply rollers 32 assists an operation of the registration rollers 13 is carried out while supplying print sheets P. Hereinafter, a sheet supply control including the assistant operation will be explained.

Figure 3:
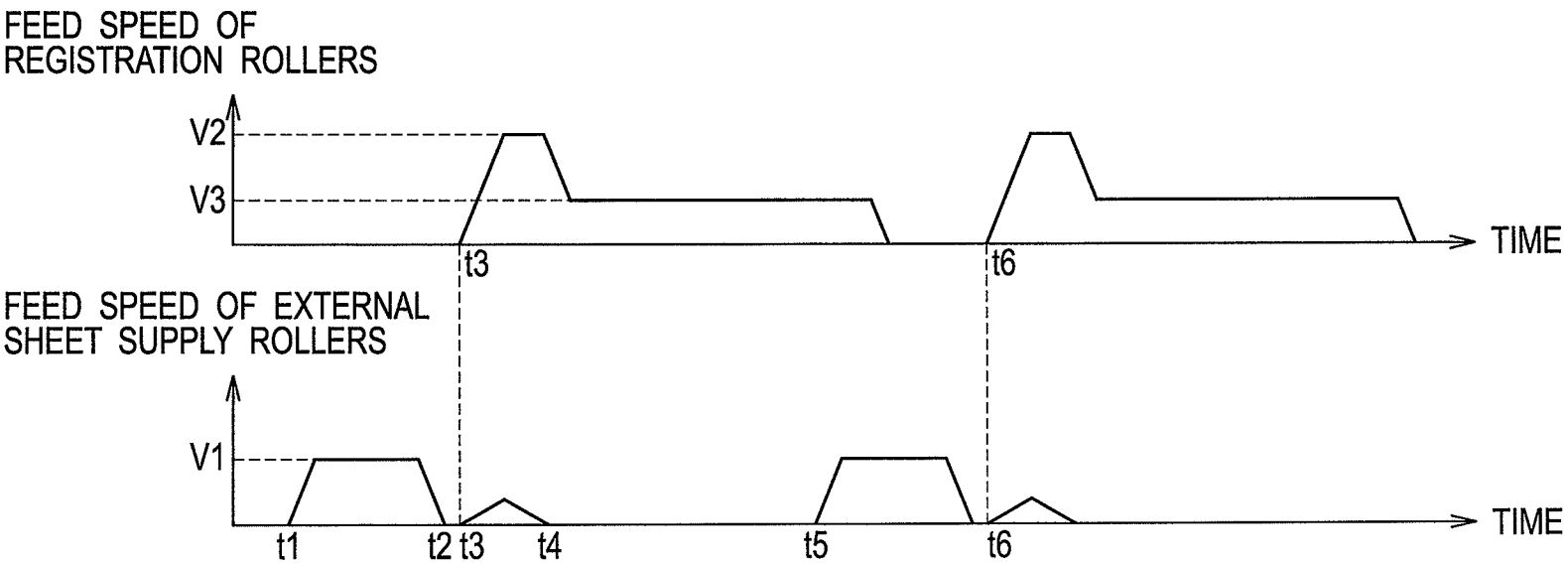
FIG. 3 is a timing chart explaining a sheet supply control in which print sheets are sequentially supplied form an external sheet supply unit.

First, a sheet supply control for sequentially supplying print sheets from the external sheet supply unit 12 will be explained with reference to a timing chart shown in FIG. 3. In FIG. 3, an upper graph shows a transitional change of a feed speed of the registration rollers 13, and a lower graph shows a transitional change of a feed speed of the intermediate feed rollers 24.

As shown in FIG. 3, in a case of sequentially supplying print sheets P from the external sheet supply unit 12, the controller 5 starts the rotation of the external sheet supply rollers 32 by driving the intermediate feed motor 15 in a normal rotational direction at a time t1. When the feed speed of the external sheet supply rollers 32 reaches to a predetermined feed speed V1, the controller 5 keeps the feed speed V1 for a predetermined duration time and then stops the intermediate feed motor 15. As a result, the rotation of the external sheet supply rollers 32 is stopped at a time t2. During a drive period of the external sheet supply rollers 32 from the time t1 to the time t2, the external sheet supply rollers 32 pick-up and feed-out a print sheet P, and then contact a leading edge of the print sheet P with a registration nip between the registration rollers 13 to slack the print sheet P.

After the rotation of the external sheet supply rollers 32 is stopped, the controller 5 starts the rotation of the registration rollers 13 by driving the registration motor 16 at a time t3. When the feed speed of the registration rollers 13 reaches to a predetermined feed speed V2, the controller 5 keeps the feed speed V2 for a predetermined duration time and then reduces the feed speed to a feed speed V3. The feed speed V3 is almost identical to a feed speed by the feed belt unit 41. Subsequently, the controller 5 keeps the feed speed V3, and then stops the registration motor 16 at a time when a trailing edge of the print sheet P has passed through the registration rollers 13. As a result, the rotation of the registration rollers 13 is stopped.

In addition, the controller 5 starts the assistant operation by the external sheet supply rollers 32 at the same time when the registration rollers 13 start rotating. Specifically, the controller 5 starts the rotation of the external sheet supply rollers 32 by driving the intermediate feed motor 15 in a normal rotational direction at the time t3. After the feed speed of the registration rollers 13 has been accelerated up to the feed speed V2, the controller 5 starts decelerating of the intermediate feed motor 15 and then stops the intermediate feed motor 15. As a result, the rotation of the external sheet supply rollers 32 is stopped. The controller 5 controls the assistant operation so as not to pass a trailing edge of the print sheet P completely through the registration rollers 13 at a time t4 when the rotation of the external sheet supply rollers 32 has been stopped. This process is made in order to prevent the external sheet supply unit 12 (the external sheet supply rollers 32) from erroneously feeding out the next print sheet P.

According to the above-explained operations, a print sheet P is fed from the external sheet supply unit 12 to the print unit 3 via the registration rollers 13. In a case where sequentially feed print sheets P from the external sheet supply unit 12, the controller 5 repeats the above-explained drive controls of the external sheet supply rollers 32 and the registration rollers 13 as shown in FIG. 3. Here, a time t5 to start the rotation of the external sheet supply rollers 32 for picking-up and feeding-out the next print sheet P from the external sheet supply tray 31 is determined according to a time t6 when the rotation of the registration rollers 13 is to be started for the next print sheet P. The time t6 is determined as a feed start time to set a sheet distance (interval) between a precedent print sheet P and a following print sheet P to a predetermined distance. In detail, the sheet distance is a distance between a trailing edge of a precedent print sheet P and a leading edge of a following print sheet P.

Figure 4:
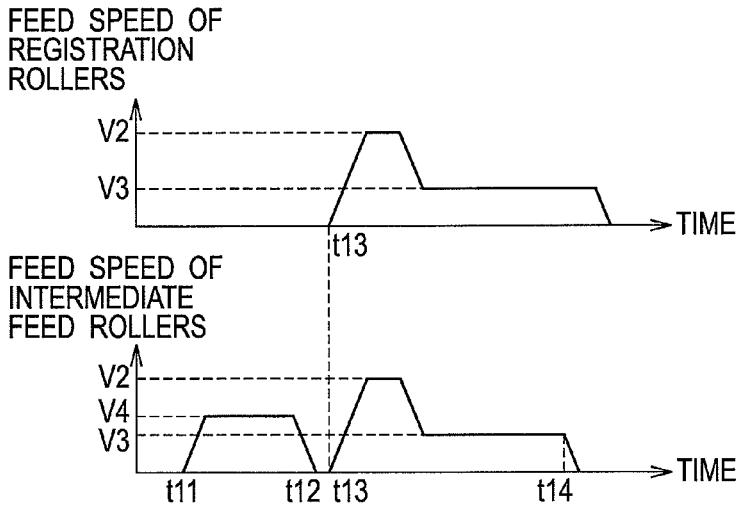
FIG. 4 is a timing chart explaining a sheet supply control in which a print sheet is supplied form an internal sheet supply unit.

Next, a sheet supply control for supplying a print sheet from the internal sheet supply unit 11 will be explained with reference to a timing chart shown in FIG. 4. In FIG. 4, an upper graph shows a transitional change of a feed speed of the registration rollers 13, and a lower graph shows a transitional change of a feed speed of the intermediate feed rollers 24.

As shown in FIG. 4, in a case of supplying a print sheet P from the internal sheet supply unit 11, the controller 5 connects the internal sheet supply rollers 22 and the feed rollers 23 (that are associated with the internal sheet supply tray 21 on which a print sheet P to be printed is stacked) with the internal sheet supply motor 14 by the above-explained clutches. Then, the controller 5 rotates the internal sheet supply rollers 22 and the feed rollers 23 by driving the internal sheet supply motor 14. The internal sheet supply rollers 22 pick-up and feed-out a print sheet P from the internal sheet supply tray 21, and the feed rollers 23 feed the print sheet P to the intermediate feed rollers 24.

At a time t11 before the print sheet P fed by the internal sheet supply rollers 22 and the feed rollers 23 reaches to the intermediate feed rollers 24, the controller 5 rotates the intermediate feed rollers 24 by driving the intermediate feed motor 15 in a reverse rotational direction. When the feed speed of the intermediate rollers 24 reaches to a predetermined feed speed V4, the controller 5 keeps the feed speed V4 for a predetermined duration time and then stops the intermediate feed motor 15. As a result, the rotation of the intermediate feed rollers 24 is stopped at a time t12. During a drive period of the intermediate feed rollers 24 from the time t11 to the time t12, the intermediate feed rollers 24 feed the print sheet P to the registration rollers 13, and contact a leading edge of the print sheet P with a registration nip between the registration rollers 13 to slack the print sheet P.

At a time t13 after the rotation of the intermediate feed rollers 24 is stopped, the controller 5 starts the rotation of the registration rollers 13 by driving the registration motor 16. When the feed speed of the registration rollers 13 reaches to a predetermined feed speed V2, the controller 5 keeps the feed speed V2 of the registration rollers 13 for a predetermined duration time and then reduces the feed speed to a feed speed V3. The feed speed V3 is almost identical to a feed speed by the feed belt unit 41. Subsequently, the controller 5 keeps the feed speed V3, and then stops the registration motor 16 at a time when a trailing edge of the print sheet P has passed through the registration rollers 13. As a result, the rotation of the registration rollers 13 is stopped.

In addition, the controller 5 starts the assistant operation by the intermediate feed rollers 24 at the same time when the rotation of the registration rollers 13 is started. Specifically, the controller 5 starts the rotation of the intermediate feed rollers 24 by driving the intermediate feed motor 15 in a reverse rotational direction at the time t13.

After the feed speed of the registration rollers 13 has been accelerated up to the feed speed V2, the controller 5 keeps the feed speed V2 of the intermediate feed rollers 24 for a predetermined duration time and then reduces the feed speed to the feed speed V3, similarly to the registration rollers 13. At a time t14 when a trailing edge of the print sheet P has passed through the registration rollers 13, the controller 5 starts to stop the intermediate feed motor 15. As a result, the rotation of the intermediate feed rollers 24 is stopped. Here, the controller 5 judges that the trailing edge of the print sheet P has passed through the registration rollers 13 when the sheet sensor 25 detects the trailing edge of the print sheet P.

According to the above-explained operations, a print sheet P is fed from the internal sheet supply unit 11 to the print unit 3 via the registration rollers 13. As explained above, the intermediate feed rollers 24 assist the registration rollers 13 until the trailing edge of the print sheet P has passed through the intermediate feed rollers 24 by their operations in synchronization with the registration rollers 13. According to these operations, the registration rollers 13 and the intermediate feed rollers 24 feed the print sheet P while keeping the slack of the print sheet P until the trailing edge of the print sheet P has passed through the intermediate feed rollers 24.

Figure 5:
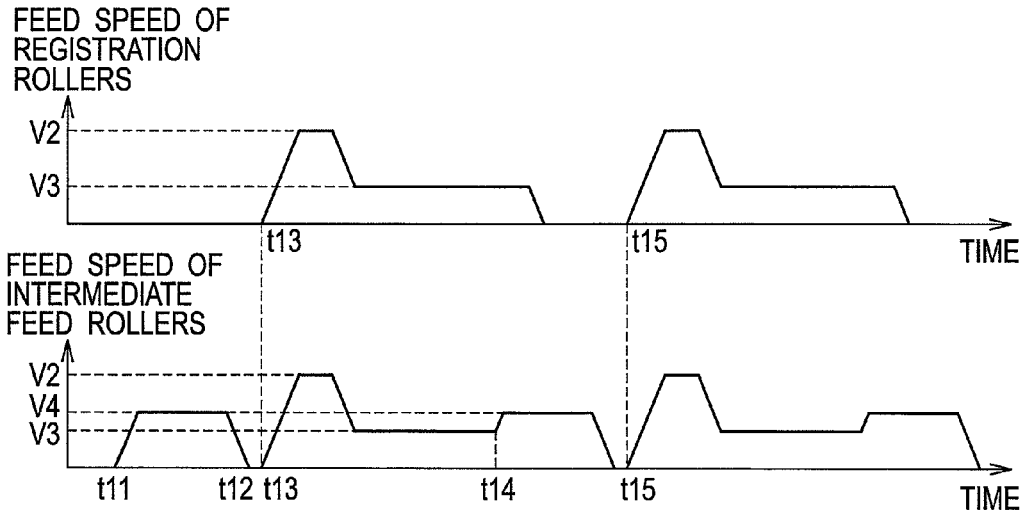
FIG. 5 is a timing chart explaining a sheet supply control in which print sheets are sequentially supplied form an external sheet supply unit.

In a case where sequentially feed print sheets P from the internal sheet supply unit 11, as shown in FIG. 5, the controller 5 starts accelerating of the feed speed of the intermediate feed rollers 24 at the time t14 when the trailing edge of the print sheet P has passed through the registration rollers 13, and the feed speed of the intermediate feed rollers 24 is accelerated up to the feed speed V4. The controller 5 keeps the feed speed V4 for a predetermined duration time, and then stops the intermediate feed motor 15. As a result, the rotation of the intermediate feed rollers 24 is stopped. According to these operations, the intermediate feed rollers 24 feed the next print sheet P to the registration rollers 13, and contact a leading edge of the next print sheet P with a registration nip between the registration rollers 13 to slack the next print sheet P.

Then, the controller 5 starts the assistant operation by the intermediate feed rollers 24 at the same time t15 when the rotation of the registration rollers 13 is started. According to these operations, the registration rollers 13 and the intermediate feed rollers 24 feed the next print sheet P while keeping the slack of the next print sheet P. Here, similarly to the above-explained case of sequentially feeding print sheets P from the external sheet supply unit 12, the time t15 is determined as a feed start time to set a sheet distance between a precedent print sheet P and a following print sheet P to a predetermined distance.

Note that, although the internal sheet supply tray 21 as sheet supply sources may be changed while sequentially feeding print sheets P from the internal sheet supply unit 11, the above-explained operations are executed also in this case. In this case, if a sheet size changes due to a change of the internal sheet supply tray 21 as sheet supply sources, drive times of the registration rollers 13 and the intermediate feed rollers 24 may inevitably change.

Next, a sheet supply control in which a sheet supply source is changed over between the internal sheet supply unit 11 and the external sheet supply unit 12 will be explained with reference to timing charts shown in FIG. 6 and FIG. 7.

In the printer 1, while executing a print job(s) that uses various types (e.g. different sizes) of print sheets P, a sheet supply source of the print sheets P may be changed between the internal sheet supply unit 11 and the external sheet supply unit 12. When changing the sheet supply source from the internal sheet supply unit 11 to the external sheet supply unit 12, the controller 5 executes different controls between a silent mode (FIG. 6) and a print productivity priority mode (FIG. 7).

First, a sheet supply control for the silent mode will be explained with reference to a timing chart shown in FIG. 6. In FIG. 6, an upper graph shows a transitional change of a feed speed of the registration rollers 13, a middle graph shows a transitional change of a feed speed of the external sheet supply rollers 32, and a lower graph shows a transitional change of a feed speed of the intermediate feed rollers 24. Here, the first and third sheets are fed from the external sheet supply unit 12, and the second sheet is fed from the internal sheet supply unit 11.

Figure 6:
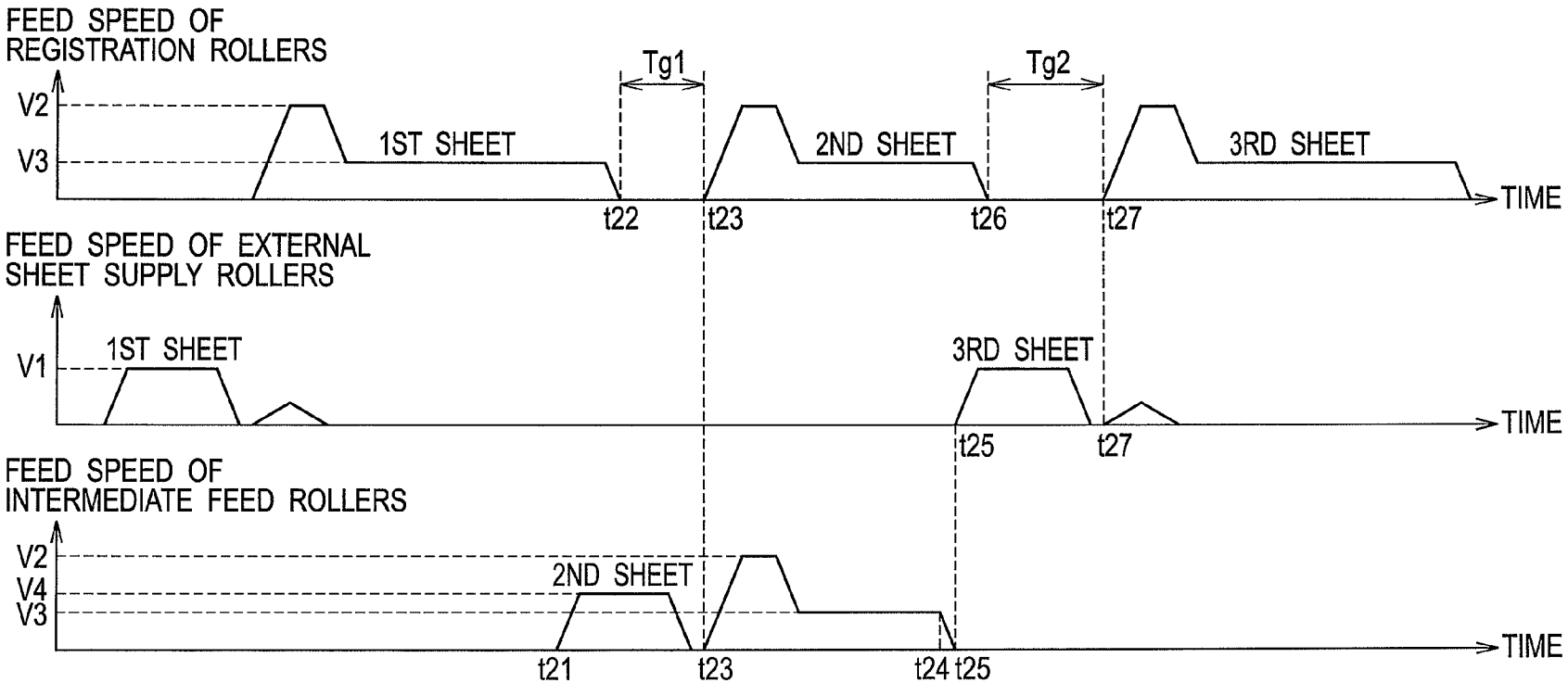
FIG. 6 is a timing chart explaining a sheet supply control in a silent mode.

As shown in FIG. 6, the controller 5 rotates the external sheet supply rollers 32 and then the registration rollers 13 in order to supply the first print sheet P, similarly to the case shown in FIG. 3. At a time t21 after execution of the assistant operation by the external sheet supply rollers 32 for the first print sheet P, the controller 5 starts the rotation of the intermediate feed rollers 24 by driving the intermediate feed motor 15 in a reverse rotational direction in order to supply the second print sheet P. Then, the controller 5 rotates the intermediate feed rollers 24 and then the registration rollers 13, similarly to the case shown in FIG. 4. Here, the time t21 to start the rotation of the registration rollers 13 for feeding the second print sheet P is determined so as to set a sheet distance between the first print sheet P and the second print sheet P to a predetermined distance.

At a time t24 when a trailing edge of the second print sheet has passed through the intermediate feed rollers 24, the controller 5 stats to stop the intermediate feed motor 15. At a time t25 when the rotation of the intermediate feed rollers 24 is stopped due to a stop of the intermediate feed motor 15, the controller 5 starts the rotation of the external sheet supply rollers 32 by driving the intermediate feed motor 15 in a normal rotational direction. In other words, the rotational direction of the intermediate feed motor 15 is changed over from the reverse rotational direction (for rotating the intermediate feed rollers 24) to the normal rotational direction (for rotating the external sheet supply rollers 32) at the time t25. According this operation, picking-up and feeding-out of the third print sheet P from the external sheet supply tray 31 is started. Then, the controller 5 rotates the external sheet supply rollers 32 and the registration rollers 13 at a time t27, similarly to the case shown in FIG. 3.

Next, a sheet supply control for the print productivity priority mode will be explained with reference to a timing chart shown in FIG. 7. Similarly to FIG. 6, upper, middle and lower graphs in FIG. 7 show transitional change of feed speeds of the registration rollers 13, the external sheet supply rollers 32, and the intermediate feed rollers 24, respectively. Also in this case, the first and third sheets are fed from the external sheet supply unit 12, and the second sheet is fed from the internal sheet supply unit 11.

In the above-explained sheet supply control of the silent mode shown in FIG. 6, the controller 5 starts to stop the reverse rotational drive of the intermediate feed motor 15 (to stop the rotational of the intermediate feed rollers 24) at the time t24 when the trailing edge of the second print sheet P has passed through the intermediate feed rollers 24. Then, the controller 5 starts the rotation of the external sheet supply rollers 32 by driving the intermediate feed motor 15 in a normal rotational direction at the time t25 when the rotation of the intermediate feed rollers 24 is stopped due to a stop of the intermediate feed motor 15.

Figure 7:
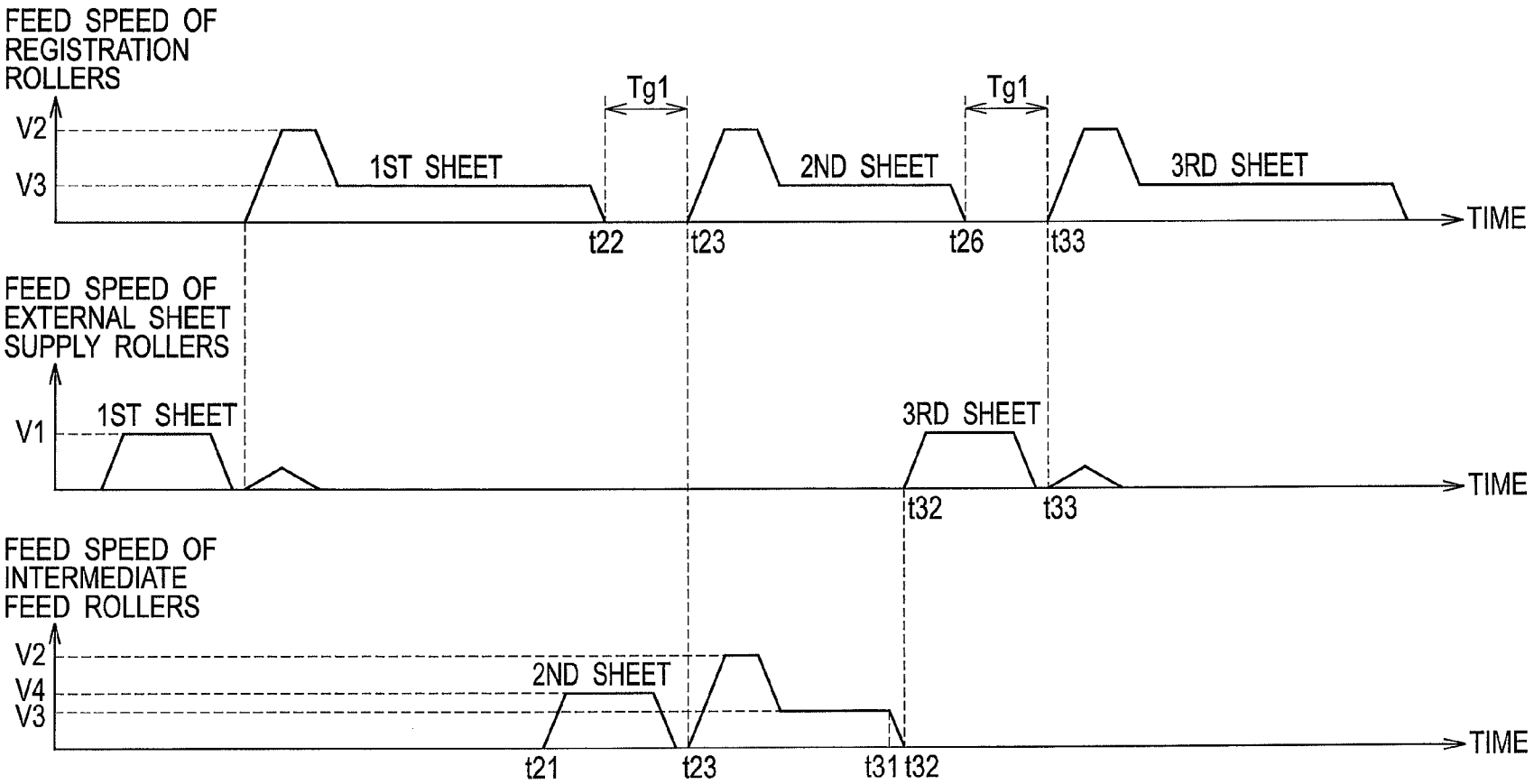
FIG. 7 is a timing chart explaining a sheet supply control in a productivity priority mode.

On the other hand, in the silent mode shown in FIG. 7, the controller 5 starts to stop the intermediate feed motor 15 at a time t31 before a trailing edge of the second print sheet P has passed through the intermediate feed rollers 24. Then, the controller 5 starts the rotation of the external sheet supply rollers 32 by driving the intermediate feed motor 15 in a normal rotational direction at a time t32 when the rotation of the intermediate feed rollers 24 is stopped due to a stop of the intermediate feed motor 15. In other words, the rotational direction of the intermediate feed motor 15 is changed from the reverse rotational direction (for rotating the intermediate feed rollers 24) to the normal rotational direction (for rotating the external sheet supply rollers 32) at the time t32. According to this operation, picking-up and feeding-out of the third print sheet P from the external sheet supply tray 31 is started. Then, the controller 5 rotates the external sheet supply rollers 32 and the registration rollers 13 at a time t33, similarly to the case shown in FIG. 3.

Although the trailing edge of the second print sheet P is still nipped between the intermediate feed rollers 24 at the time t32 when the rotation of the intermediate feed rollers 24 is stopped, the intermediate feed rollers 24 are passively rotated along with feeding of the second print sheet P by the registration rollers 13. Therefore, the second print sheet P passes through the intermediate feed rollers 24, and then is fed to the print unit 3 by the registration rollers 13.

Here, the time t33 is determined as a feed start time to set a sheet distance between the second print sheet P and the third print sheet P to the same predetermined distance as that between the first print sheet P and the second print sheet P. As explained above, in the print productivity priority mode, a drive schedule for the registration rollers 13 is determined so as to set sheet distances between fed print sheets P to the predetermined distance even when changing over a sheet supply source from the internal sheet supply unit 11 to the external sheet supply unit 12.

Relative to the time t33 to start the rotation of the registration rollers 13, the controller 5 determined the time t32 as a feed start time to pick-up and feed-out the third print sheet P and then contact a leading edge of the third print sheet P with a registration nip between the registration rollers 13 to slack the third print sheet P. Further, the controller 5 starts the rotation of the external sheet supply rollers 32 at the time t32. In other words, the controller 5 determines the start time t31 to stop the reverse rotational drive of the intermediate feed motor 15 (the rotation of the intermediate feed rollers 24) for the assistant operation for the second print sheet P in order to start the normal rotational drive of the intermediate feed motor 15 (the rotation of the external sheet supply rollers 32) for picking-up and feeding-out of the third print sheet P at an adequate timing.

In the above-explained print productivity priority mode, the sheet supply operation is executed so as to set the sheet distance between the second print sheet P and the third print sheet P to the same distance as that between the first print sheet P and the second print sheet P. Therefore, as shown in FIG. 7, a duration between the time t22 (when the rotation of the registration rollers 13 for feeding the first print sheet P is stopped) and the time t23 (to start the rotation of the registration rollers 13 for feeding the second print sheet P) and a duration between the time t26 (when the rotation of the registration rollers 13 for feeding the second print sheet P is stopped) and the time t33 (to start the rotation of the registration rollers 13 for feeding the third print sheet P) are set to Tg1.

On the other hand, in the above-explained silent mode, the assistant operation by the intermediate feed rollers 24 for the second print sheet P is continued until the trailing edge of the second print sheet P has passed through the intermediate feed rollers 24. Therefore, the time t25 (show in FIG. 6) to start the rotation of the external sheet supply rollers 32 becomes later the time t32 (shown in FIG. 7) when the rotation of the external sheet supply rollers 32 is started in the print productivity. As a result, as shown in FIG. 7, a duration Tg2 between the time t26 (when the rotation of the registration rollers 13 for feeding the second print sheet P is stopped) and the time t27 (to start the rotation of the registration rollers 13 for feeding the third print sheet P) becomes longer than the duration Tg1 between the time t22 and the time t23. Since noise suppression is given priority over print productivity in the silent mode, a time loss (Tg2−Tg1) is needed for changing over a sheet supply source from the internal sheet supply unit 11 to the internal sheet supply unit 12.

However, in the silent mode shown in FIG. 6, the slack of the second print sheet P is kept until the trailing edge has passed through the intermediate feed rollers 24 at the time t24, so that the above-explained back tension is not applied to the second print sheet P between the registration rollers 13 and the intermediate feed rollers 24. Therefore, the above-explained sheet expansion noises and the feeding failures can be reduced. On the other hand, in the print productivity priority mode shown in FIG. 7, the assistant operation by the intermediate feed rollers 24 is finished before the trailing edge has passed through the intermediate feed rollers 24. In other words, the rotation of the intermediate feed rollers 24 is stopped at the time t32 in a state where the second print sheet P is nipped between the intermediate feed rollers 24. Therefore, there is a possibility that the back tension may be applied to the second print sheet P between the registration rollers 13 and the intermediate feed rollers 24 (after the time t32). But, even in the print productivity priority mode, the assistant operation by the intermediate feed rollers 24 is executed when supplying the second print sheet P (from the time t23 to the time t32), so that advantages of reducing the sheet expansion noises and the feeding failures can be brought.

Note that, when changing over a sheet supply source from the external sheet supply unit 12 that supplies the first print sheet P to the internal sheet supply unit 11 that supplies the second print sheet, the rotation of the intermediate feed rollers 24 is started at the time t21 after the assistant operation by the external sheet supply rollers 32 is finished both in the silent mode shown in FIG. 6 and the print productivity priority mode shown in FIG. 7. Since the assistant operation by the external sheet supply rollers 32 is finished for a short time, the assistant operation by the external sheet supply rollers 32 doesn't affect the print productivity. Therefore, it is possible to start the rotation of the intermediate feed rollers 24 for feeding the next print sheet P immediately at an adequate timing (i.e. the time t21). Note that, as explained above, the assistant operation by the external sheet supply rollers 32 is finished for a short time in order to prevent the external sheet supply unit 11 (the external sheet supply rollers 32) from feeding out a print sheet erroneously.

Figure 8:
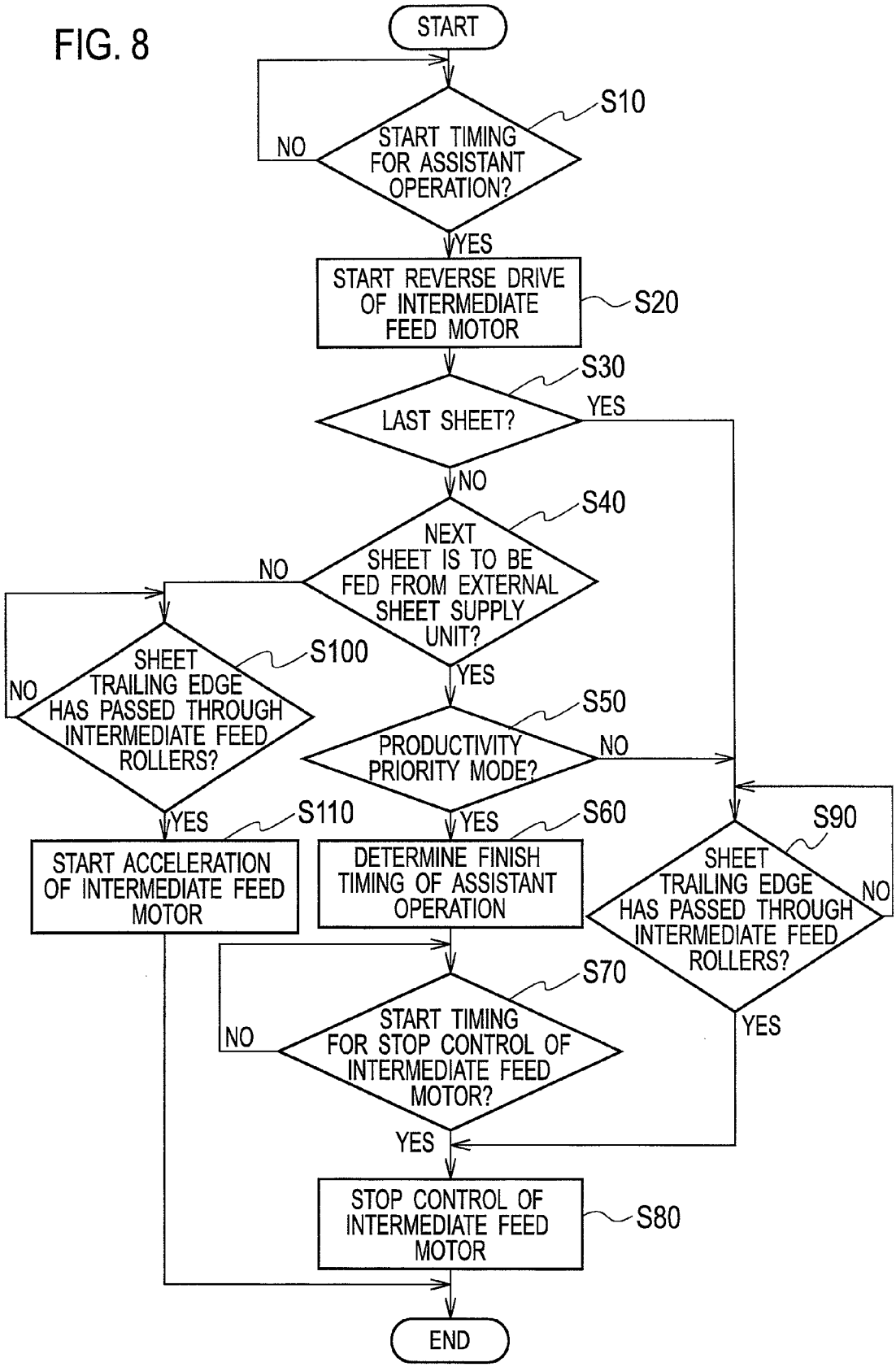
FIG. 8 is a flowchart showing processes of an assistant operation by intermediate feed rollers.

Next, the assistant operation by the intermediate feed rollers 24 will be explained with reference to a flowchart shown in FIG. 8.

A program for executing a processing shown in the flowchart is started at a time when the rotation of the intermediate feed rollers 24 for forming a slack of the print sheet P is stopped.

The controller 5 determines whether or not it is a start timing for the assistant operation (step S10). The start timing for the assistant operation is the same as a timing to start the rotation of the registration rollers 13. When it is determined that it is not the timing to start the assistant operation (No in step S10), the controller 5 repeats the process in step S10 until the step S10 becomes affirmative.

When it is determined that it is the timing to start the assistant operation (Yes in step S10), the controller 5 starts to drive the intermediate feed motor 15 in a reverse rotational direction (step S20). By driving the intermediate feed motor 15 in the reverse rotational direction, the intermediate feed rollers 24 are rotated. In addition, the controller 5 starts to drive the registration motor 16, and thereby the registration rollers 13 are rotated. Then, the controller 5 rotates the intermediate feed rollers 24 in synchronization with the registration rollers 13 as shown in FIG. 4 and so on. According to the synchronized rotations of the intermediate feed rollers 24 and the registration rollers 13, a print sheet P is fed to the print unit 3 by the registration rollers 13 while being assisted by the intermediate feed rollers 24.

Subsequently, the controller 5 determines whether or not a print sheet P being fed by the registration rollers 13 and the intermediate feed rollers 24 is the last sheet in a current print job (step S30).

When it is determined that the print sheet P being fed is not the last sheet (No in step S30), the controller 5 determines whether or not the next print sheet P is to be supplied from the external sheet supply unit 12 (step S40).

When it is determined that the next print sheet P is to be supplied from the external sheet supply unit 12 (Yes in step S40), the controller 5 is determined that the print productivity priority mode is being selected (step S50).

When it is determined that the print productivity priority mode is being selected (Yes in step S50: i.e. being in the print productivity priority mode), the controller 5 determines a finish timing for the assistant operation by the intermediate feed rollers 24 (step S60). This process corresponds to a determination of the above-explained time t32 shown in FIG. 7. Namely, by reversely calculation from a start timing to start the rotation of the registration rollers 13 for setting a sheet distance between the print sheet P currently fed and the next print sheet P to be fed to the predetermined distance (corresponding to the duration Tg1), the finish timing (corresponding to the time t32) to finish the assistant operation for the print sheet P currently fed is determined. Then, the controller 5 determines a timing (corresponding to the time t31) when to start to stop the intermediate feed motor 15 in order to finish the assistant operation at the determined timing (i.e. the time t32).

Subsequently, the controller 5 determined whether or not it is the above-explained start timing (corresponding to the time t31) to stop the intermediate feed motor 15 (step S70). When it is determined that it is not the start timing to stop the intermediate feed motor 15 (No in step S70), the controller 5 repeats the process in step S70 until the step S70 becomes affirmative.

On the other hand, when it is determined that it is the start timing to stop the intermediate feed motor 15 (Yes in step S70), the controller 5 starts to stop the intermediate feed motor 15 (step S80). This process corresponds to a start of the stop control of the intermediate feed motor 15 at the time t31 in order to stop the intermediate feed motor 15 (the rotation of the intermediate feed rollers 24) at the time t32 as shown in FIG. 7. As a result, the rotation of the intermediate feed rollers 24 are sopped and the assistant operation is finished.

To return to step S50, when it is determined that the print productivity priority mode is not being selected (No in step S50: i.e. being in the silent mode), the controller 5 determines whether or not a trailing edge of the print sheet P has passed through the intermediate rollers 24 (step S90). Here, the controller 5 determines that a trailing edge of the print sheet P has passed through the intermediate rollers 24 when the trailing edge of the print sheet P is detected by the sheet sensor 25. When it is determined that the trailing edge of the print sheet P has not passed through the intermediate rollers 24 (No in step S90), the controller 5 repeats the process in step S90 until the step S90 becomes affirmative.

When it is determined that the trailing edge of the print sheet P has passed through the intermediate rollers 24 (Yes in step S90), the controller 5 starts to stop the intermediate feed motor 15 (step S80). This process corresponds to a start of the stop control of the intermediate feed motor 15 at the time t24 in order to stop the intermediate feed motor 15 (the rotation of the intermediate feed rollers 24) at the time t25 as shown in FIG. 6. As a result, the rotation of the intermediate feed rollers 24 are sopped and the assistant operation is finished.

To return to step S40, when it is determined that the next print sheet P is to be supplied from the internal sheet supply unit 11 (No in step S40), the controller 5 determines whether or not a trailing edge of the print sheet P has passed through the intermediate rollers 24 (step S100). When it is determined that the trailing edge of the print sheet P has not passed through the intermediate rollers 24 (No in step S100), the controller 5 repeats the process in step S100 until the step S100 becomes affirmative.

When it is determined that the trailing edge of the print sheet P has passed through the intermediate rollers 24 (Yes in step S100), the controller 5 starts to accelerate the intermediate feed motor 15 (step S110) in order to change the feed speed of the intermediate feed rollers 24 from a speed for the assistant operation to a speed for feeding the next print sheet P. This process corresponds to a start of the acceleration from the feed speed V3 to the feed speed V4 at the time t14 as shown in FIG. 5. As a result, the assistant operation by the intermediate feed rollers 24 is finished.

To return to step S30, when it is determined that the print sheet P being fed is the last sheet (Yes in step S30), the controller 5 advances the process flow to step S90. Then, the process flow is advanced as explained above until the assistant operation is finished.

According to the above-explained embodiment, when a sheet supply source is changed over from the internal sheet supply unit 11 to the external sheet supply unit 12 in the print productivity priority mode, the assistant operation by the intermediate feed rollers 24 is finished before the trailing edge of the print sheet P has passed through the intermediate feed rollers 24 by stopping the intermediate feed motor 15. Therefore, a delay in starting to feed the next print sheet P from the external sheet supply unit 12 can be reduced and thereby a time loss can be reduced. As a result, the printer 1 can restrict reduction of print productivity while reducing sheet expansion noises due to a back tension applied to a print sheet P caused by the assistant operation and reducing feed failures.

Specifically, in the above-explained embodiment, when a sheet supply source is changed over from the internal sheet supply unit 11 to the external sheet supply unit 12 in the print productivity priority mode, the timing to finish the assistant operation by the intermediate feed rollers 24 is determined according to the drive schedule of the registration rollers 13 for setting sheet distances (intervals) between sequentially-fed print sheets P to a predetermined distance. Therefore, in the print productivity priority mode, print sheets P can be fed sequentially with constant sheet distances even when a sheet supply source is changed over from the internal sheet supply unit 11 to the external sheet supply unit 12. As a result, the printer 1 can maintain print productivity in the print productivity priority mode while reducing sheet expansion noises due to a back tension applied to a print sheet P caused by the assistant operation and reducing feed failures.

Note that the silent mode may not be provided. In this case, the assistant operation by the intermediate feed rollers 24 is always executed in the print productivity priority mode. In addition, when a sheet supply source is changed over from the internal sheet supply unit 11 to the external sheet supply unit 12 in the print productivity priority mode, the assistant operation by intermediate feed rollers 24 may not be executed.

Further, the controller 5 may select the print productivity mode or the silent mode according to a print job. For example, since loudness of a sheet expansion noise due to a bask tension varies according to a type and/or a size of a print sheet P, the controller 5 may automatically selects the silent mode for a print job by which a sheet supply source is to be changed from the internal sheet supply unit 11 to the external sheet supply unit 11 and a print sheet P to be supplied from the external sheet supply unit 12 has a type and/or a size that may generates a large sheet expansion noise. Further, in a case with a print job for printing print sheets more than the predetermined number of sheets for example, the controller 5 may automatically select the silent mode. According to this configuration, the printer 1 can execute sheet-supplying/feeding appropriate for a print job.

Furthermore, the present invention can be applied to a printer that includes plural external sheet supply units 12 and in which a single intermediate feed motor 15 selectively drive the external sheet supply rollers 32 of the plural external sheet supply units 12 and the intermediate feed rollers 24 of the internal sheet supply unit 11.

The present invention is not limited to the above-mentioned embodiment, and it is possible to embody the present invention by modifying the components in the range that does not depart from the scope thereof. Further, it is possible to form various kinds of inventions by appropriately combining a plurality of components disclosed in the above-mentioned embodiment. For example, it may be possible to omit several components from all of the components shown in the above-mentioned embodiment.

The present application claims the benefit of a priority under 35 U.S.C §119 to Japanese Patent Application No. 2012-98796, filed on Apr. 24, 2012, the entire content of which is incorporated herein by reference.

What is claimed is:

1. A printer comprising:

a print unit including at least one print head;

a pair of registration rollers for feeding a print sheet to the print unit;

a first sheet supply unit including a first feed roller that feeds a print sheet to the pair of registration rollers, and operates, by rotating in synchronization with the pair of registration rollers, an assistant operation to assist feeding of the print sheet by the pair of registration rollers;

a second sheet supply unit including a second feed roller that feeds a print sheet to the pair of registration rollers;

a drive unit that selectively drives the first feed roller and the second feed roller; and a controller that controls the drive unit, wherein the controller, when changing over a sheet supply source of print sheets from the first sheet supply unit to the second sheet supply unit in the assistant operation by the first feed roller, finishes the assistant operation before a trailing edge of a print sheet currently fed has passed through the first feed roller by stopping the drive unit.

2. The printer according to claim 1, wherein the controller, when changing over the sheet supply source from the first sheet supply unit to the second sheet supply unit in the assistant operation by the first feed roller, finishes the assistant operation according to a drive schedule of the pair of registration rollers for setting sheet distances between sequentially-fed print sheets to a predetermined distance.

3. The printer according to claim 2, wherein the printer is provided with a print productivity priority mode in which the assistant operation by the first feed roller is finished before a trailing edge of a print sheet currently fed has passed through the first feed roller, and a noise suppression priority mode in which the assistant operation by the first feed roller is finished when or after a trailing edge of a print sheet currently fed has passed through the first feed roller, and the controller, when changing over the sheet supply source from the first sheet supply unit to the second sheet supply unit in the assistant operation by the first feed roller, is capable of selecting the print productivity priority mode or the noise suppression priority mode according to a print job.

4. The printer according to claim 1, wherein the printer is provided with a print productivity priority mode in which the assistant operation by the first feed roller is finished before a trailing edge of a print sheet currently fed has passed through the first feed roller, and a noise suppression priority mode in which the assistant operation by the first feed roller is finished when or after a trailing edge of a print sheet currently fed has passed through the first feed roller, and the controller, when changing over the sheet supply source from the first sheet supply unit to the second sheet supply unit in the assistant operation by the first feed roller, is capable of selecting the print productivity priority mode or the noise suppression priority mode according to a print job.

* * * * *